US011505363B1

(12) United States Patent
Chadwick

(10) Patent No.: US 11,505,363 B1
(45) Date of Patent: Nov. 22, 2022

(54) BOX WITH PRODUCT-RETAINING FILM

(71) Applicant: Packaging Corporation of America, Lake Forest, IL (US)

(72) Inventor: Adrien G. Chadwick, Warren, NJ (US)

(73) Assignee: Packaging Corporation of America, Lake Forest, IL (US)

( * ) Notice: Subject to any disclaimer, the term of this patent is extended or adjusted under 35 U.S.C. 154(b) by 132 days.

(21) Appl. No.: 17/025,585

(22) Filed: Sep. 18, 2020

Related U.S. Application Data

(60) Provisional application No. 62/902,301, filed on Sep. 18, 2019.

(51) Int. Cl.

| | |
|---|---|
| ***B65D 5/56*** | (2006.01) |
| ***B65D 5/50*** | (2006.01) |
| ***B65D 5/66*** | (2006.01) |
| ***B65D 5/20*** | (2006.01) |

(52) U.S. Cl.
CPC ..... *B65D 5/56* (2013.01); *B65D 5/2057* (2013.01); *B65D 5/5021* (2013.01); *B65D 5/66* (2013.01)

(58) Field of Classification Search
CPC ..... B65D 81/075; B65D 5/443; B65D 5/66; B65D 5/5021; B65D 5/2057; B65D 5/56; B65B 23/00
USPC ..... 229/164.2; 206/497
See application file for complete search history.

(56) References Cited

U.S. PATENT DOCUMENTS

| | | | | |
|---|---|---|---|---|
| 2,643,811 | A | 6/1953 | Velman | |
| 3,899,119 | A * | 8/1975 | Roccaforte | B65D 5/5021 229/164 |
| 4,852,743 | A | 8/1989 | Ridgeway | |
| 5,676,245 | A | 10/1997 | Jones | |
| 5,694,744 | A | 12/1997 | Jones | |
| 5,967,327 | A * | 10/1999 | Jones | B65D 81/075 206/466 |
| 6,073,761 | A | 6/2000 | Jones | |
| 6,398,029 | B1 | 6/2002 | Farison et al. | |
| 6,675,973 | B1 | 1/2004 | McDonald et al. | |
| 6,854,599 | B2 | 2/2005 | Ferrara, Jr. et al. | |
| 6,913,147 | B2 | 7/2005 | Mueller et al. | |
| 7,296,681 | B2 | 11/2007 | McDonald et al. | |
| 7,673,751 | B2 | 3/2010 | Keiger | |
| 7,694,496 | B2 | 4/2010 | Keiger et al. | |
| 7,731,032 | B2 | 6/2010 | McDonald et al. | |
| 7,753,209 | B2 | 7/2010 | McDonald et al. | |
| 7,775,367 | B2 | 8/2010 | McDonald et al. | |

(Continued)

OTHER PUBLICATIONS

Packaging World, Jim Butschli, "Less time + less labor and materials = savings", Oct. 31, 2002, 4 pages.

(Continued)

*Primary Examiner* — Christopher R Demeree
(74) *Attorney, Agent, or Firm* — Klarquist Sparkman, LLP

(57) ABSTRACT

A container can include a container portion comprising a plurality of walls and a first panel pivotably coupled to the container portion and configured to pivot between a first position where the first panel is arranged outside of the container portion and a second position where the first panel is arranged inside the container portion. The container can further include a tubular polymeric sleeve disposed around the first panel and covering a first surface of the first panel and a second surface on the opposite side of the first panel from the first surface, where the polymeric sleeve is unsecured to the first panel.

18 Claims, 7 Drawing Sheets

(56) References Cited

U.S. PATENT DOCUMENTS

| | | | | |
|---|---|---|---|---|
| 7,918,339 | B2 | 4/2011 | Kashiwabara | |
| 7,931,151 | B2 * | 4/2011 | McDonald | B65D 5/5021 206/583 |
| 8,123,039 | B2 | 2/2012 | McDonald et al. | |
| 8,177,067 | B2 * | 5/2012 | McDonald | B65D 5/5021 206/583 |
| 8,234,844 | B2 | 8/2012 | Davlin et al. | |
| 8,505,731 | B2 | 8/2013 | McDonald et al. | |
| 8,584,843 | B2 | 11/2013 | Hillard | |
| 8,714,357 | B2 | 5/2014 | Ridgeway | |
| 8,910,784 | B2 | 12/2014 | Moore et al. | |
| 9,150,343 | B2 * | 10/2015 | Roberts | B65D 81/075 |
| 9,309,024 | B2 | 4/2016 | Hammerschmidt et al. | |
| 9,352,891 | B2 | 5/2016 | LeRoy et al. | |
| 9,821,925 | B2 | 11/2017 | Yamazaki et al. | |
| 9,828,160 | B2 | 11/2017 | Ridgeway | |
| 9,868,577 | B2 | 1/2018 | Ridgeway | |
| 9,868,578 | B2 | 1/2018 | Ridgeway | |
| 10,035,638 | B1 | 7/2018 | LeRoy | |
| 10,442,597 | B1 | 10/2019 | LeRoy | |
| 10,556,717 | B2 | 2/2020 | Lun et al. | |
| 10,597,184 | B2 | 3/2020 | Yamazaki et al. | |
| 10,683,154 | B2 | 6/2020 | Hammerschmidt | |
| 10,994,889 | B1 * | 5/2021 | Rumsam | B65D 5/5004 |
| 2004/0108239 | A1 | 6/2004 | McDonald et al. | |
| 2006/0113215 | A1 | 6/2006 | Clements et al. | |
| 2006/0138018 | A1 * | 6/2006 | McDonald | B65D 5/5021 206/583 |
| 2008/0110788 | A1 * | 5/2008 | Keiger | B65D 81/075 206/521 |
| 2008/0223750 | A1 * | 9/2008 | McDonald | B65D 81/02 206/583 |
| 2013/0306510 | A1 | 11/2013 | Scott | |
| 2018/0002095 | A1 | 1/2018 | McDonald et al. | |
| 2018/0141700 | A1 | 5/2018 | Ridgeway et al. | |
| 2018/0327164 | A1 * | 11/2018 | Kiessner | B65D 5/4266 |
| 2020/0172314 | A1 | 6/2020 | Roesler et al. | |

OTHER PUBLICATIONS

Korpack, "Retention And Suspension: Korrvu By Sealed Air", Sep. 28, 2018, retrieved from https://www.korpack.com/news-and-events/2018/09/28/retention-and-suspension-korrvu-by-sealed-air/, 1 page.

* cited by examiner

BOX WITH PRODUCT-RETAINING FILM

CROSS REFERENCE TO RELATED APPLICATION

This application claims the benefit of U.S. Provisional Application No. 62/902,301, which was filed on Sep. 18, 2019, and which is incorporated herein by reference in its entirety.

FIELD

The present disclosure pertains to boxes comprising product support assemblies with separable polymeric product-retaining sleeves.

BACKGROUND

Part of the experience of receiving a package is the excitement or anticipation of opening the package and viewing the product contained in the package for the first time. To heighten the experience, the product can be positioned in a manner such that it is easily viewed and/or accessed by the user upon opening the box. However, such a product position or orientation can present challenges because the ideal viewing position may leave the product poorly supported or protected during shipping, which can risk damaging the product. Additionally, existing packaging solutions where the product is retained by a polymeric film rely on composite paperboard and polymeric materials, which are not easily separated (e.g., the polymeric materials are adhered or secured to the paperboard), thereby rendering the package difficult or impossible to recycle. Accordingly, there exists a need for containers or boxes that can protect a product during shipping and enable the product to be easily viewed upon opening the container, while also having its components unattached to one another such that the components of differing materials are readily separable from one another for recycling.

SUMMARY

Disclosed herein are examples of containers (e.g., boxes) that can be configured to retain a product securely against one or more panels of the container, while allowing the product to be easily viewed upon opening of the container. For example, the containers disclosed herein can include polymeric sleeves that are configured to retain a product securely against one or more panels of the container and that are unattached to, and thus removable from, the one or more panels of the container.

In one representative embodiment, a container comprises a container portion comprising a plurality of walls and a first panel pivotably coupled to the container portion. The first panel is configured to pivot between a first position where the first panel is arranged outside of the container portion and a second position where the first panel is arranged inside the container portion. The container further comprises a tubular polymeric sleeve disposed around the first panel and covering a first surface of the first panel and a second surface on the opposite side of the first panel from the first surface. The polymeric sleeve is unsecured to the first panel.

In some embodiments, the first panel includes a support panel extending outward from a main panel portion of the first panel and coupled to the main panel portion at a fold line.

In some embodiments, the first panel is pivotably coupled to the container portion at a first end portion of the first panel and the support panel is arranged at a second end portion of the first panel, the first end portion arranged opposite the second end portion across the first panel.

In some embodiments, in the second position of the first panel, a free end of the support panel is configured to contact a bottom wall of the container portion and the main panel portion of the first panel is suspended above the bottom wall.

In some embodiments, the first panel is pivotably coupled to a front wall of the container portion and the container further comprises a cover pivotably coupled to a rear wall of the container portion.

In some embodiments, the first panel is pivotably coupled to the container portion via a second panel of the container portion, the second panel including a first end portion pivotably coupled to a wall of the plurality of walls of the container portion and a second end portion, the first panel pivotably coupled to the second end portion of the second panel.

In some embodiments, in the second position, the first surface of the first panel is arranged against the second panel and both the first panel and the second panel are arranged inside the container portion.

In some embodiments, in the first position, the first surface of the first panel is arranged against the second panel and both the first panel and the second panel are arranged outside of the container portion and the first panel is further pivotable between a third position and the first position, the first panel extending away from the second panel in the third position.

In some embodiments, in the first position and the second position, one layer of the tubular polymeric sleeve is sandwiched between the first panel and the second panel.

In some embodiments, the second panel includes an opening and, in the second position, the tubular polymeric sleeve is viewable through the opening.

In some embodiments, the tubular polymeric sleeve comprises a resiliently stretchable polymeric film.

In another representative embodiment, a container comprises a container portion comprising a plurality of walls and a first panel pivotably coupled to the container portion and configured to pivot between a first position in which the first panel is disposed outside the container portion and a second position in which the first panel is received within the container portion. The container further comprises a second panel pivotably coupled to the first panel, the second panel being pivotable between a first position in which the second panel extends away from the first panel and a second position in which the second panel is received against the first panel. The container further comprises a polymeric sleeve disposed around the second panel, the polymeric sleeve unsecured to the second panel. When the second panel is in the second position, a side of the polymeric sleeve that is configured to retain a product inserted inside the polymeric sleeve against the second panel is arranged between the first panel and the second panel.

In some embodiments, the second panel extends from the first panel and is pivotably coupled to a first end portion of the first panel and a second end portion of the first panel is pivotably coupled to a front wall of the container portion, the first end portion and the second end portion arranged opposite one another across the first panel.

In some embodiments, the first panel defines an opening therein and the opening is arranged against the second panel and the polymeric sleeve when the second panel is in the second position.

In some embodiments, the container further comprises two or more support panels, including one or more first support panels extending from and pivotably coupled to the first panel and a second support panel extending from and pivotably coupled to the second panel. The two or more support panels are configured to support the first panel and the second panel against a bottom wall of the container portion when the first panel is in the second position and the second panel is in the second position.

In some embodiments, the polymeric sleeve is tubular with at least one open end.

In some embodiments, when the second panel is in the second position, an opposing side of the polymeric sleeve which is arranged opposite the side that is configured to retain the product inserted inside the polymeric sleeve against a first surface of the second panel covers an opposite, second surface of the second panel.

In another representative embodiment, a container comprises a container portion comprising a plurality of walls, a cover coupled to the container portion and configured to pivot between a closed position and an open position, and a first panel pivotably coupled to the container portion and configured to pivot between a first position in which the first panel is disposed outside the container portion and a second position in which the first panel is received within the container portion, the first panel defining an opening. The container further comprises a second panel pivotably coupled to the first panel and extending from the first panel, the second panel being pivotable between a first position in which the second panel extends away from the first panel and a second position in which the second panel is received on the first panel. The container further comprises a polymeric sleeve disposed around the second panel and rotatable around the second panel, the polymeric sleeve being configured to retain a product inserted inside the polymeric sleeve against the second panel.

In some embodiments, the polymeric sleeve includes at least one open end and the polymeric sleeve is translatable along the second panel.

In some embodiments, the polymeric sleeve is not adhered or fastened to the second panel.

In some embodiments, the polymeric sleeve is stretchable and transparent or translucent.

The foregoing and other objects, features, and advantages of the disclosed technology will become more apparent from the following detailed description, which proceeds with reference to the accompanying figures.

DETAILED DESCRIPTION

As introduced above, it may be desirable for a container or box, such as a shipping container, that is configured to protect a product during shipping and enable the product to be easily viewed after opening the container, while also having components that are not adhesively or otherwise connected to one another such that the components made of differing materials are readily and/or fully separable from one another for recycling (e.g., such as the cardboard container and a polymeric film or sleeve) without damaging the container and/or leaving an adhesive residue behind on the container (which can render the container unrecyclable).

As such, the present disclosure pertains to shipping boxes or containers that include an insert or product support assembly comprising a first panel pivotably coupled to a container portion of the box and a polymeric product-retaining sleeve disposed around the first panel. The sleeve can be unattached to the first panel. In some embodiments, the sleeve can be tubular.

In some embodiments, the product support assembly can comprise a product platform (e.g., first panel), a viewing panel (e.g., second panel), and a polymeric product-retaining film or sleeve that is disposed around the product platform and freely movable relative to the product platform. The product platform and the viewing panel can be pivotable relative to each other and relative to the container portion of the box such that a product inserted between the sleeve and the product platform can be positioned in a viewing window of the viewing platform and supported or suspended above the floor of the container portion by the viewing panel and the product platform.

Due to the lack of adhesive or other securing means securing the polymeric sleeve to the product platform, the polymeric sleeve can be separated from the container and the materials recycled.

Figure 1:
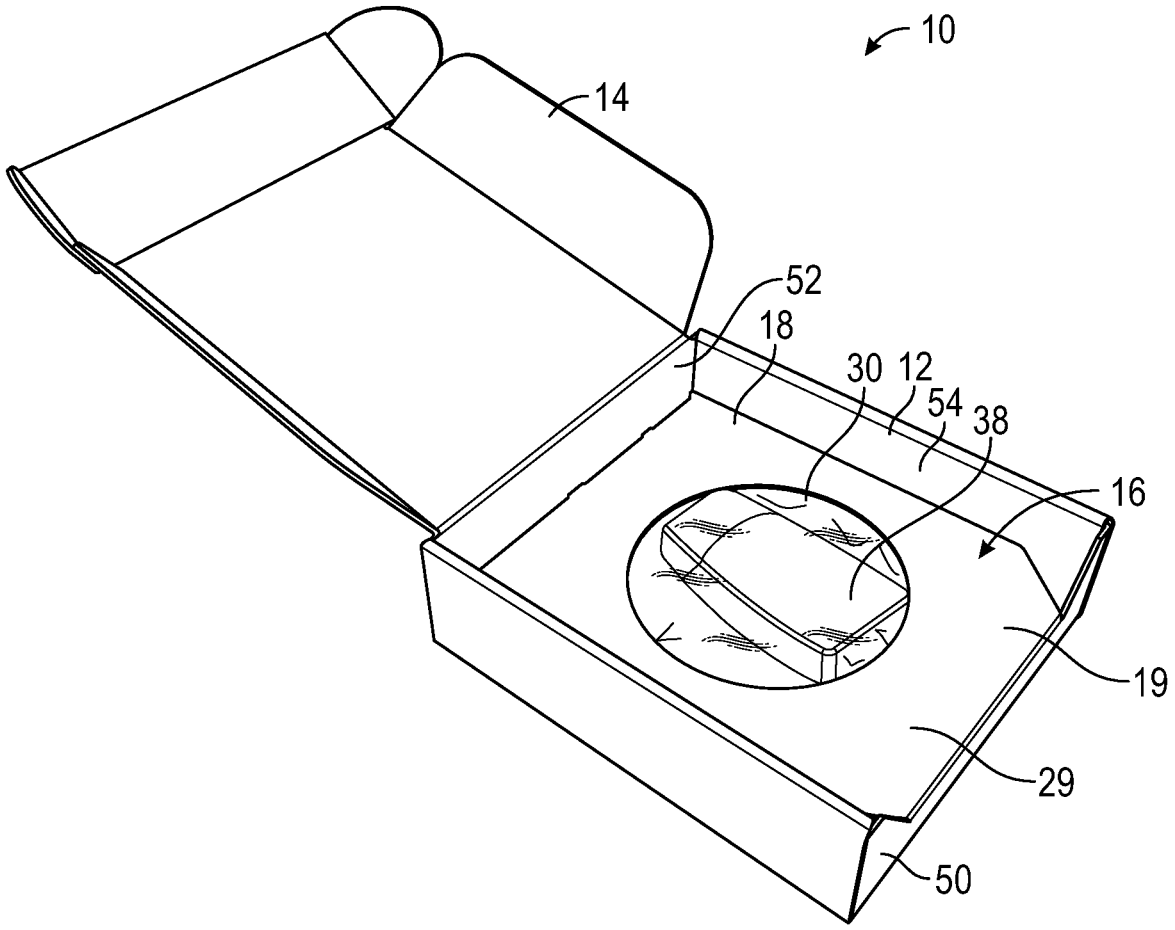
FIG. 1 is a perspective view of a box with a pivotable product support assembly and separable sleeve, according to one embodiment.
Figure 2:
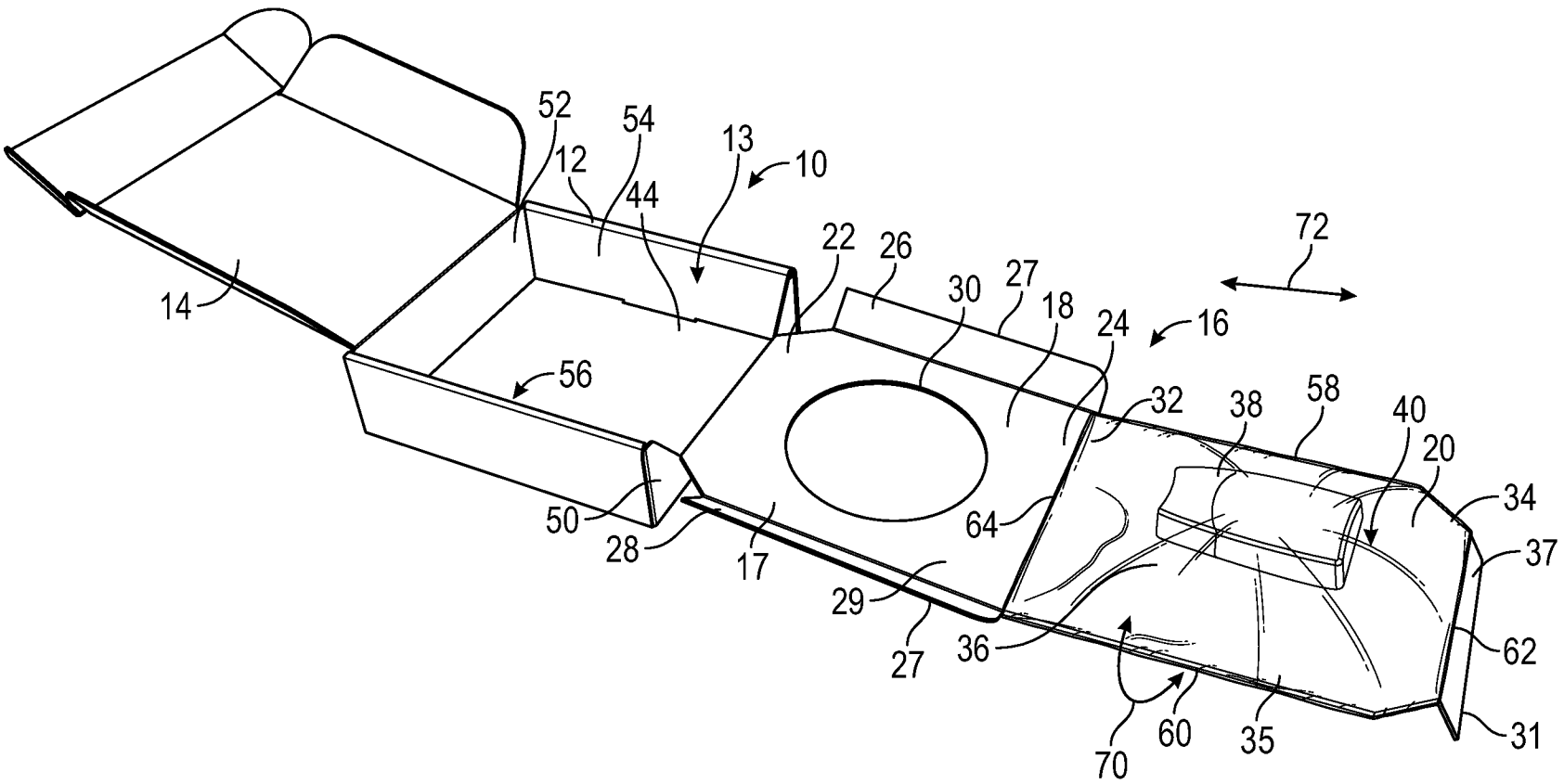
FIG. 2 is a perspective view of the box of FIG. 1 with a viewing panel and a product platform in a first position.
Figure 3:
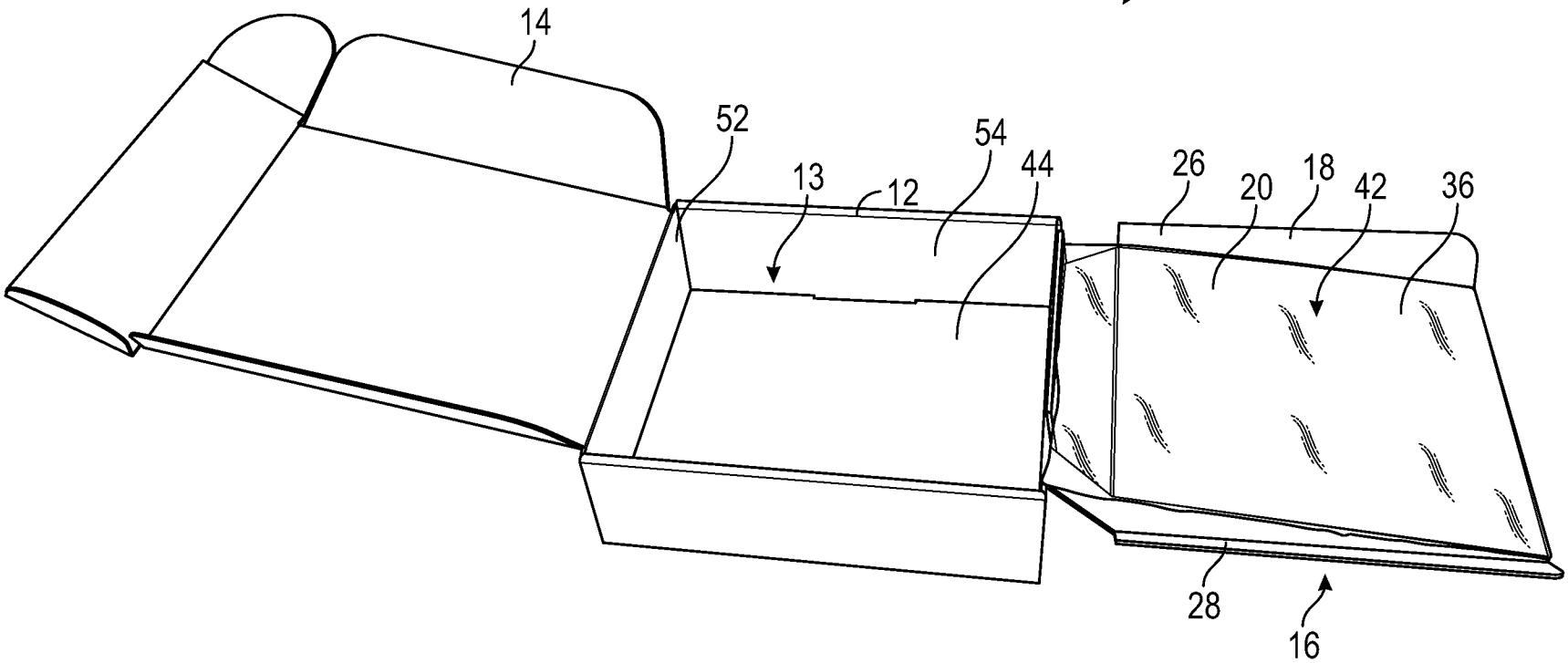
FIG. 3 is a perspective view of the box of FIG. 1 with the product platform pivoted to a second position.
Figure 4:
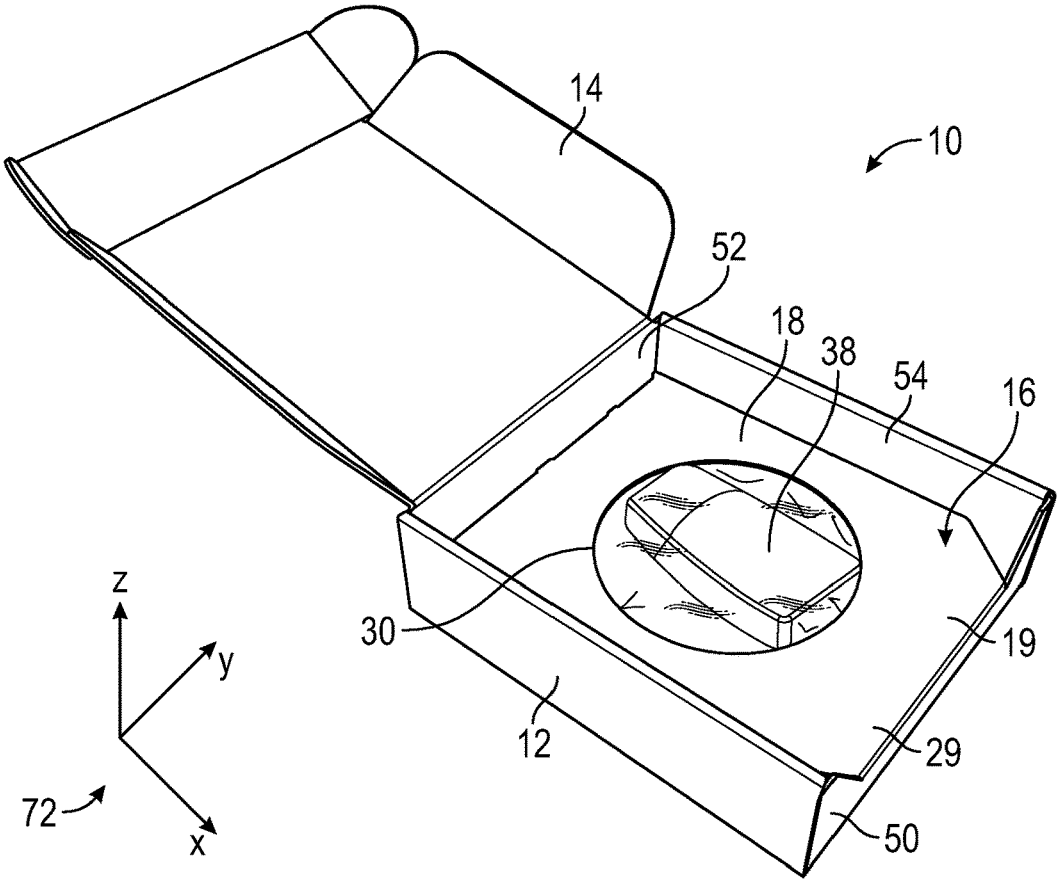
FIG. 4 is a perspective view of the box of FIG. 1 with the viewing panel pivoted to a second position.
Figure 5:
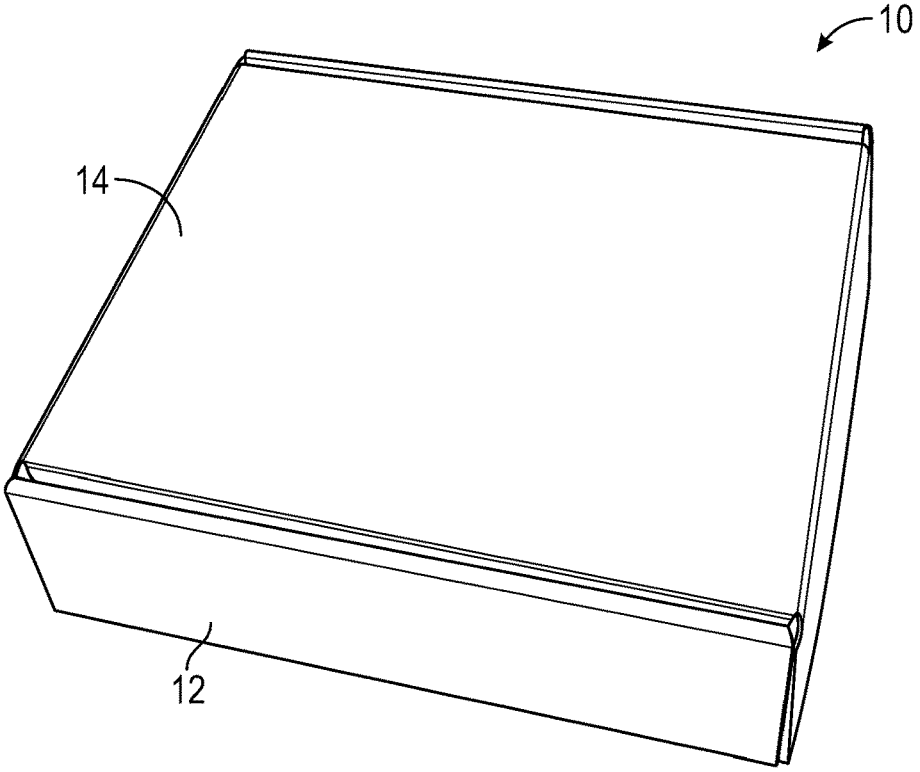
FIG. 5 is a perspective view of the box of FIG. 1 with the cover in the closed position.
Figure 6:
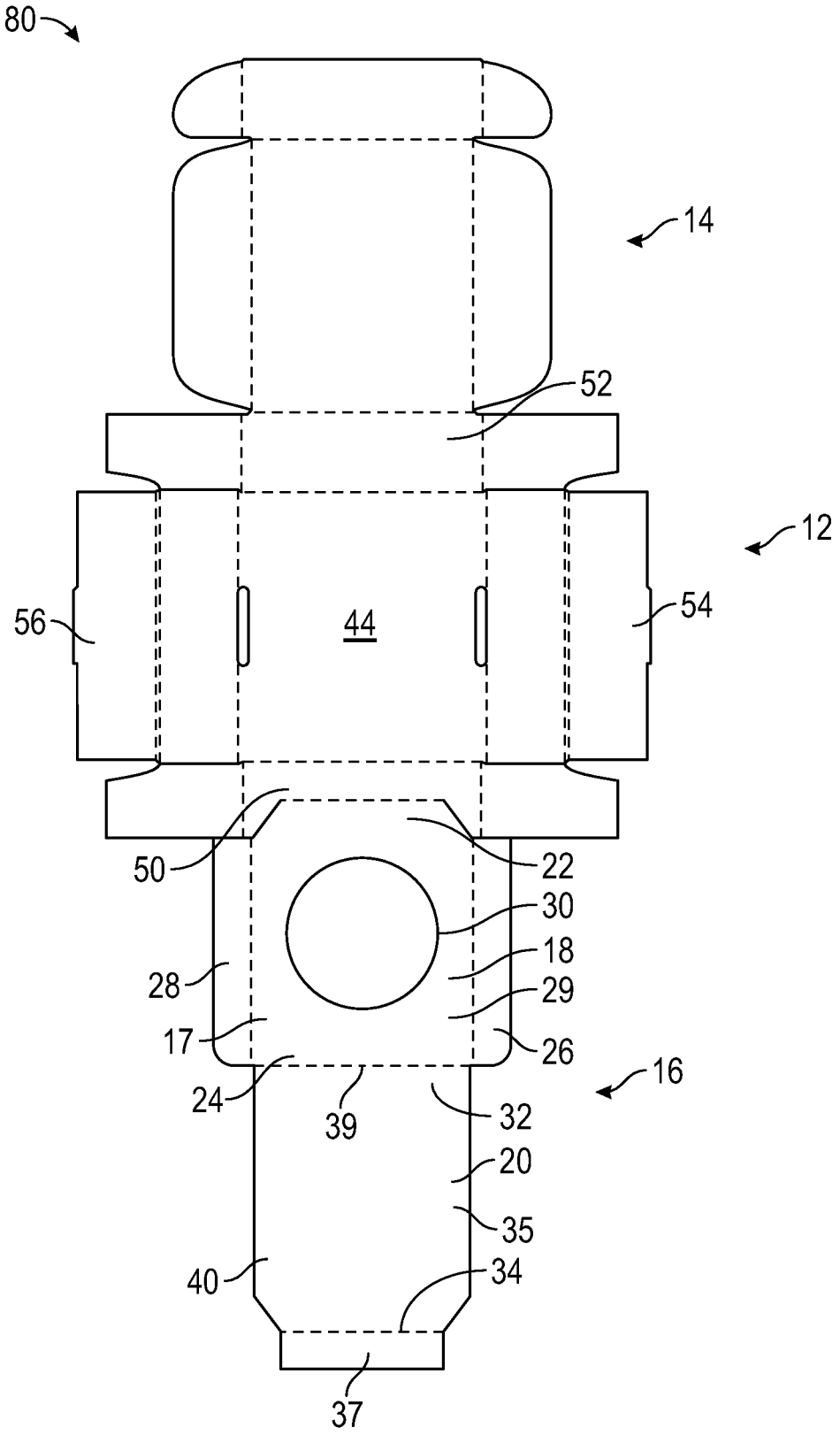
FIG. 6 is a top plan view of a representative embodiment of a blank from which the box of FIG. 1 can be constructed.

FIGS. 1-6 illustrate different views of a representative example of a container or box 10 with a product-retaining sleeve or film. More specifically, FIG. 1 is a perspective view of the box 10 in an assembled configuration (e.g., where a product is secured and supported within the box 10) and FIG. 2 is a perspective view of the box 10 in a disassembled configuration (e.g., where the product can be loaded into/secured onto a portion of the box, but is not yet fully disposed within the box 10). FIGS. 3-5 illustrate perspective views of the box 10 in various stages of assembling the box 10 such that the product can be shipped or transported within the box 10. FIG. 6 is a view of a representative embodiment of a blank from which the box of FIGS. 1-5 can be constructed.

As shown in FIGS. 1-6, the box 10 can comprise a container portion 12 and a cover (which can also be referred to as a top or lid) 14 configured to cover and uncover the container portion 12. In some embodiments, as shown in FIGS. 1-6, the cover 14 can be coupled to the container portion 12.

The container portion 12 can comprise an insert or product support assembly 16 comprising a series of panels pivotably coupled to each other end-to-end and configured to fold into and out of a cavity 13 of the container portion 12. The cavity 13 of the container portion 12 can be defined by a plurality of walls (or panels) of the container portion 12, including a front wall 50, a rear wall 52, a first side wall 54, a second side wall 56, and a bottom (or floor) wall 44 (as shown in FIGS. 2, 3, and 6). The cavity 13 can also be referred to herein as an interior or inside of the container portion 12.

The product support assembly 16 is arranged within the container portion 12 in FIGS. 1, 4, and 5 (not visible in FIG. 5 due to the box 10 being in a closed configuration) and is arranged out of the container portion 12 in FIGS. 2 and 3. The product support assembly 16 can comprise at least one panel that is pivotably coupled to the container portion 12 and configured to pivot between a first position where the panel is arranged outside the container portion 12 and a second position where the panel is arranged inside the container portion 12. The at least one panel of the product support assembly 16 can be configured to receive a product thereon.

For example, in some embodiments, the product support assembly 16 can comprise a first panel configured as a viewing panel (e.g., product viewing panel) 18 and a second panel configured as a product support panel or product platform 20 (as best seen in FIGS. 2, 3, and 6). The viewing panel 18 can be pivotably coupled to the front wall 50 of the container portion 12 at a first end portion 22 of the viewing panel 18, and pivotably coupled to the product platform 20 at a second end portion 24 (FIGS. 2 and 6).

The viewing panel 18 can comprise one or more extension portions/panels/flaps configured to support the product support assembly 16 within the container portion 12. In some embodiments, as shown in FIGS. 2, 3, and 6, the one or more extension portions of the viewing panel 18 include two extension portion that are configured as first and second support panels 26 and 28. The first and second support panels 26 and 28 can be arranged along edges of a main panel portion 29 of the viewing panel 18 that extend between the first end portion 22 and the second end portion 24 of the viewing panel 18. For example, in some embodiments, the first and second support panels 26 and 28 can be coupled to the main panel portion 29 via respective folding lines about which the first and second support panels 26 and 28 are configured to pivot or fold relative to the main panel portion 29. In this way, the first and second support panels 26 and 28 can be pivotably (or foldably) coupled to the main panel portion 29.

In some embodiments, when the product support assembly 16 is arranged within the cavity 13 of the container portion 12, free ends 27 of the first and second support panels 26 and 28 can contact the bottom wall 44 of the container portion 12, thereby supporting the product support assembly 16 within the container portion 12. In such a position, a product 38 retained by the product support assembly 16 (as described further below) can be suspended above (and spaced away from) the bottom wall (e.g., floor) 44 of the container portion 12.

The viewing panel 18 can further define an opening (e.g., window) 30 (FIGS. 1, 2, 4, and 6). In some embodiments, the opening 30 can be defined in the main panel portion 29, between the first and second support panels 26 and 28. In some embodiments, the opening 30 can be centered within the main panel portion 29.

The viewing panel 18 can include a first surface 17 (FIGS. 2 and 6) and a second surface 19 (FIGS. 1 and 4), the second surface 19 arranged on an opposite side of the viewing panel 18 from the first surface 17. The opening 30 can be formed in and extend through each of the first surface 17 and the second surface 19. In some embodiments, the first surface 17 and the second surface 19 can be planar surfaces that are arranged parallel to one another.

The product platform 20 can comprise a first end portion 32 pivotably coupled to the second end portion 24 of the viewing panel 18 and a free, second end portion 34 (FIGS. 2 and 6). The first end portion 32 and the second end portion 24 are arranged opposite one another across the product platform 20. The product platform 20 can also include a first surface 40 (FIG. 2) and a second surface 42 (FIG. 3), the second surface 42 being on the opposite side of the product platform 20 from the first surface 40. In some embodiments, the first surface 40 and the second surface 42 can be planar surfaces that are parallel to one another.

In some embodiments, the product platform 20 can further comprise a pivotable extension portion configured as a support panel 37 located at the second end portion 34. For example, in some embodiments, the support panel 37 can extend outward from a main panel portion 35 of the product platform 20 and be configured to fold relative to the main panel portion 35 via a fold line 34 (FIG. 6). In some embodiments, when the product support assembly 16 is arranged within the cavity 13 of the container portion 12, a free end 31 of the support panel 37 can contact the bottom wall 44 of the container portion 12, thereby at least partially supporting the product support assembly 16 within the container portion 12.

The product platform 20 can be movable or pivotable between a first position in which the product platform extends outwardly from the viewing panel 18 and away from the container portion 12 (FIG. 2) and a second position in which the first surface 40 of the product platform 20 is arranged against (e.g., in face-to-face contact), received on, nested with, and/or arranged adjacent to the first surface 17 of the viewing panel 18 (FIG. 3). In this way, the product platform 20 can be configured to fold over, along fold line 39, from the first position to the second position where the product platform 20 is folded over and received against the viewing panel 18. In some embodiments, in the second position of the product platform 20, the first surface 40 of the product platform can be in face-to-face contact with the first surface 17 of the viewing panel 18.

The viewing panel 18 can also be pivotable between a first position (FIGS. 2 and 3) in which the viewing panel 18 is disposed outside of the container portion 12, and a second position (FIGS. 1 and 4) in which the viewing panel 18 (and the product platform 20) are disposed within the container portion 12. For example, in the second position of the viewing panel 18, the viewing panel 18 and the product platform 20 are disposed within the cavity 13 of the container portion 12, with the product panel 20 between the bottom panel 44 of the container and the viewing panel 18. In this position, the cover 14 can be closed over the cavity 13 and against the container portion 12, such that the box 10 is in a closed configuration (FIG. 5).

In some embodiments, the first position of the viewing panel 18 can be a first position of the product platform 20, the second position of the viewing panel 18 can be a second position of the product platform 20, and the product platform can be further pivotable into a third position where the product platform 20 extends away from the viewing panel 18 (as shown in FIG. 2).

In certain embodiments, a film layer, sheet, wrap, membrane, or sleeve 36 (FIGS. 1-4) can be disposed on/around the product platform 20 to retain a product on or against the product platform. As described further below, in some embodiments, the sleeve 36 can be a polymeric sleeve 36 comprising a polymer that is configured to enable a user to at least partially see through the sleeve 36.

In certain embodiments, the sleeve 36 can be a tubular band of material. For example, in some embodiments, first ends (or sides/edges) 58 and 60 of the sleeve 36 can be secured or formed together to form a ring, tube, band, or endless loop, which can be disposed around the product platform 20 such as by slipping or sliding the sleeve 36 over the free, second end portion 34 of the product platform 20 (FIG. 2). In other words, the sleeve 36 can extend from the first surface 40 of the product platform 20 to the second surface 42 and back to the first surface 40 such that the sleeve 36 forms a double layer around the product platform 20 (e.g., extending around the product platform 20 in a direction shown by arrow 70 in FIG. 2). Thus, when arranged around the product platform 20, as shown in FIGS. 1-4, the sleeve 36 can cover the first surface (or side) 40 and the second surface (or side) 42 of the product platform 20. As a result of its tubular or endless loop configuration, and it being unattached to the product platform 20 (as described further below), the sleeve 36 can rotate around the product platform 20, as shown by arrow 70 in FIG. 2. In some embodiments, the sleeve 36 can be referred to herein as a tubular polymeric sleeve 36.

The sleeve 36 can additionally include second ends (or sides/edges) 62 and 64 (FIG. 2), at least one of which is open. In some embodiments, both of the second ends 62 and 64 can be open. In this way, the sleeve 36 can be easily slipped or slid over the free, second end portion 34 of the product platform 20 and positioned around the product platform 20, between the first end portion 32 of the product platform and the support panel 37.

In certain embodiments, the sleeve 36 can be unattached or unsecured to the product platform 20 such that the sleeve is freely movable relative to product platform 20. For example, in certain embodiments, the sleeve 36 does not include adhesive, fasteners, apertures, pockets, and/or other securing means for securing/engaging the sleeve 36 to the product platform 20. Thus, the sleeve 36 can be freely rotatable around the product platform 20 (e.g., as shown by arrow 70 in FIG. 2) and/or translatable along the product platform 20 between the respective end portions (e.g., as shown by arrow 72 in FIG. 2), at least prior to insertion of a product. Each of these attributes is within the scope of the term "unsecured."

In certain embodiments, sleeve 36 can have a length (e.g., a dimension extending between second ends 62 and 64) and a width (e.g., a dimension extending between first ends 58 and 60) that is larger than a corresponding length and width, respectively, and/or a diameter (e.g., if circular) of the opening 30. For example, in some embodiments, the sleeve 36 can be larger than the opening 30 in all dimensions.

A circumference or perimeter of the sleeve 36 can be configured such that a product 38 can be inserted inside the sleeve 36, between the sleeve 36 and the product platform 20. For example, with reference to FIG. 2, a product 38 can be inserted between the first surface 40 of the product platform 20 and the layer of the sleeve 36 adjacent the first surface 40. In some embodiments, the product 38 can be inserted between the first surface 40 of the product platform 20 and the layer of the sleeve 36 arranged adjacent to the first surface 40 via one of the open, second ends 62 and 64.

In this manner, when the product platform 20 is pivoted to the second position shown in FIG. 3, the product 38 can be pivoted by approximately 180° (e.g., counterclockwise in FIGS. 2 and 3) such that it is received in the opening 30 of the viewing panel 18. For example, in the second position of the product platform 20 shown in FIG. 3, the product 38 can be arranged between the sleeve 36 and the first surface 40 of the product platform 20 and within the opening 30.

Referring to FIG. 3, the viewing panel 18 and the product platform 20 can then be pivoted together to the second position of the viewing panel 18 such that the nested viewing panel 18 and product platform 20 are both received in the cavity 13 of the container portion 12. This action pivots the product 38 again by approximately 180° (in a counterclockwise direction in the view of FIG. 3) toward the container portion 12 such that the product 38 faces upwardly toward an open end (e.g., a top) of the container portion 12 and is viewable through the opening 30 in the viewing panel 18 (as shown in FIGS. 1 and 4). For example, as shown in FIGS. 1 and 4, the product 38 is covered by the sleeve 36 and retained against the product platform 20, and is viewable to a user/customer when the box 10 is in an open configuration (e.g., the cover 14 is moved away from the container portion 12, as shown in FIGS. 1 and 4) via the opening 30. In this position, one layer of the sleeve 36 (e.g., the layer arranged adjacent to the first surface 40 of the product platform 20) is sandwiched between the viewing panel 18 and the product platform 20, thereby holding the product 38 in place within the box 10.

In the second position of the viewing panel 18, the support panels 26, 28, and 37 can support the product support assembly 16 on the floor or bottom wall 44 of the container portion 12, while the sleeve 36 retains the product 38 against the product platform 20 and resists or prevents movement of the product relative to the product platform 20. In some embodiments, in this position, the product platform is suspended above the bottom wall 44 of the container portion 12. In some embodiments, in this position, clearance (e.g., void space) can also be created between the product 38 and one or more of the walls of the container portion 12 (e.g., one or more of the front wall 50, rear wall 52, first side wall 54, second side wall 56, and/or bottom wall 44) and/or a wall of the cover 14 (e.g., when the box 10 is in the closed position shown in FIG. 5).

For example, as shown in FIG. 4, the product 38 can be suspended above (and spaced away from) the bottom wall 44 and spaced away from the front wall 50, rear wall 52, first side wall 54, and second side wall 56. In some embodiments, the product 38 can be additionally spaced away from the cover 14 when the box 10 is in the closed position shown in FIG. 5. In this way, as shown in FIG. 4, clearance or space can be created between the product 38 and the walls of the container portion 12 and/or the cover 14 in three dimensions (e.g., the positive and negative x, y, and z directions, as shown by the coordinate system 72 in FIG. 4).

In other embodiments, a product can be arranged in the product support assembly 16 such that it is suspended above the bottom wall 44 and clearance is created in one or more additional directions (e.g., in the positive or negative x, y, and/or z directions). For example, in some embodiments, the product can be spaced away from one, two, three, four, five, or six of the front wall 50, rear wall 52, first side wall 54, second side wall 56, bottom wall 44, and cover 14.

Due to the relative arrangement between the sleeve 36, product platform 20, and viewing panel 18, and the configuration of the support panels 26, 28, and 37 discussed above, the product 38 can be restrained along and have clearance in up to three dimensions. Because the sleeve 36 holds the product against the product platform 20, the product can also be constrained or substantially constrained from rotating about any or all of the x, y, and/or z-axes. The product can thus be constrained in all six degrees of freedom.

By configuring the box 10 to provide clearance between walls of the box 10 and the product (e.g., product 38 shown in FIGS. 1, 2, and 4), additional space can be created for receiving additional products or components, such as user information (e.g., manuals, care instructions, marketing materials, or the like), packaging material (e.g., air cushioning, packing peanuts, bubble wrapping), insulation, and/or thermal control elements such as cold packs/ice packs.

In certain embodiments, the amount of clearance between the product and the walls of the box 10 can be selected (e.g., customized) based on a type and/or geometry of a product to be contained by the box 10, a specified spacing between the product and any of the walls of the container, and/or packaging materials or additional components to be arranged within the box 10, along with the product. For example, a size of the box 10 (e.g., dimensions of the walls of the container portion 12 and cover 14) and/or dimensions of the product support assembly 16 can be selected based on a specified amount of clearance between the product and the walls of the box 10.

Returning to FIG. 4, after loading the product 38 within the box 10, as described above, the cover 14 can be pivoted closed, as shown in FIG. 5.

In this way, the box 10 can include two or more support panels, including one or more first support panels (e.g., support panels 26 and 28) extending from and pivotably coupled to the main panel portion 29 of the viewing panel 18 and a second support panel (e.g., support panel 37) extending from and pivotably coupled to the main panel portion 35 of the product platform 20, where the one or more support panels are configured to support the product support assembly 16 against the bottom wall 44 of the container portion 12 when the viewing panel 18 is in the second position and the product platform 20 is in the second position.

In certain embodiments, the size or circumference of the sleeve 36 can be specified (e.g., selected) according to the shape (e.g., length, thickness, etc.) of the product to be received therein, such that the sleeve 36 is tensioned appropriately when the product is inserted between the sleeve and the product platform 20 in order to retain the product against the product platform 20.

In certain embodiments, the sleeve 36 can comprise any of a variety of heat-shrinkable polymers configured to decrease in size upon heating. In such embodiments, the product can be inserted between the sleeve 36 and the product platform 20, and the assembly can be passed through a shrink tunnel machine to heat-shrink the sleeve 36 around the product. Application of heat to shrink the sleeve 36 need not adhere the sleeve 36 to the product platform 20 or other panels of the box 10.

In certain embodiments, the sleeve 36 can comprise a resiliently stretchable polymeric film. The sleeve 36 can be configured to accommodate products of a variety of shapes and sizes. As used herein, "resiliently stretchable" can refer to a material property of the sleeve 36 that allows it to stretch under application of a pressure or a force and rebound or return to its original form or substantially its original form after being stretched (e.g., after the pressure or force is removed). As such, a resiliently stretchable polymeric film or sleeve 36 can be configured to stretch during insertion of a product between one side of the sleeve 36 and the product platform 20 and thereby retain the product in place against the product platform 20.

In certain embodiments, the sleeve 36 can be pre-stretched.

In the illustrated embodiment, the opening 30 is circular. However, in other embodiments, the opening 30 can have any of a variety of shapes configured to accommodate a variety of products. For example, the opening (e.g., window) 30 can be round, oval, square, rectangular, polygonal, or combinations thereof. Further, in some embodiments a size and/or geometry of the opening 30 can be selected based on a size and/or shape of the product to be contained within the box 10.

In certain embodiments, the sleeve 36 can be a polymeric film comprising one more thermoplastic polymers such as polyethylene, polyurethane, etc. In certain embodiments, the sleeve 36 can be transparent such that the product can be viewed through the film, or may be translucent or opaque.

In certain embodiments, the box 10 can be constructed, folded, or assembled from a single piece of material, such as corrugated paperboard having one or more face sheets with a corrugated or fluted layer therebetween. FIG. 6 shows a representative example of a corrugated paperboard blank 80 from which the box 10 can be assembled. The blank 80 can comprise a one-piece, unitary construction wherein each of the walls, extension portions, tabs, fold lines, etc., are integrally formed with the blank. As used herein, the terms "unitary construction" and "integrally formed" refer to a construction that does not include any welds, fasteners, or other means for securing separately formed pieces of material to each other. In other embodiments, any of the various panels, extension portions, tabs, etc., can be separately formed and secured to the main body of the box. The box configurations described herein can also be made from polymeric materials. In certain embodiments, the cuts, fold lines, score lines, etc., of the blank 80 can be formed in an in-line, streamlined manufacturing process such that the blank can be produced without requiring that the production equipment be stopped.

FIGS. 7-10 illustrate additional embodiments of boxes with pivotable product support assemblies and separable polymeric sleeves (e.g., sleeves that are not attached to the box via adhesive or mechanical means and are configured to be removed from the box without damaging the box or leaving behind an adhesive residue or portion of the sleeve), as described above, and including a variety of sizes of viewing windows in the viewing panels and a variety of products received in the sleeves. In certain embodiments, the containers or cartons can be provided in a variety of sizes with viewing windows of any specified shape and/or size.

Figure 7:
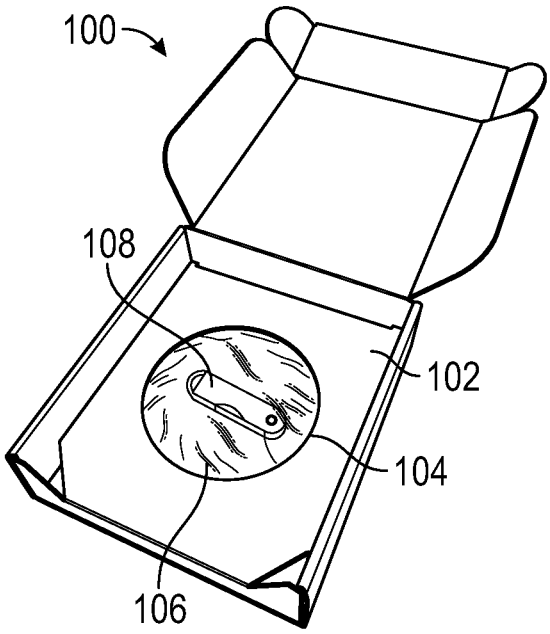
FIGS. 7 and 8 illustrate another embodiment of a box with a pivotable product support assembly having an opening of a first representative size, and a separable sleeve configured to accommodate a range of products.
Figure 8:
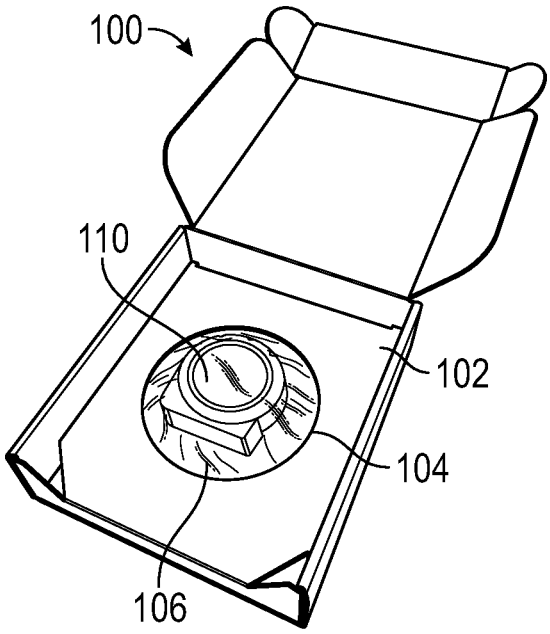

For example, FIGS. 7 and 8 show a box 100 comprising a product support assembly 102 including an opening 104 having a first size and a polymeric sleeve 106. In FIG. 7, the box 100 contains a first product 108 and in FIG. 8, the box 100 contains a second product 110, the second product 110 having a different shape and size than the first product 108.

Figure 9:
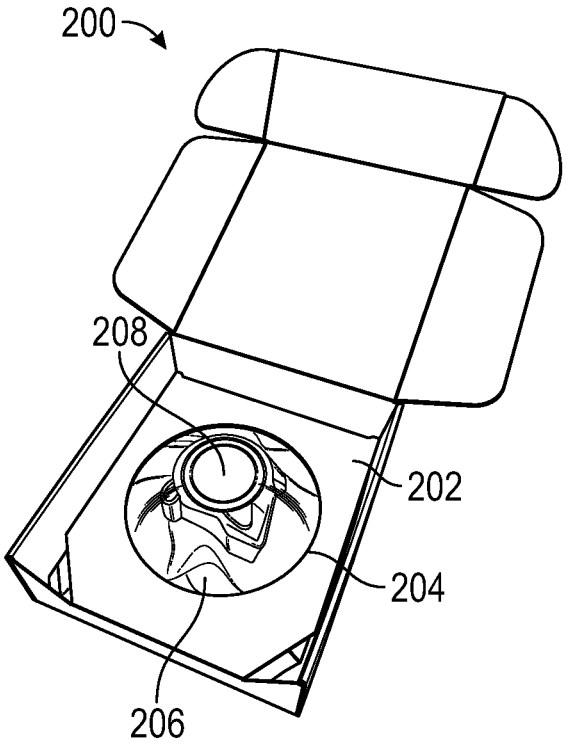
FIGS. 9 and 10 illustrate another embodiment of a box with a pivotable product support assembly having an opening of a second representative size, and a separable sleeve configured to accommodate a range of products.
Figure 10:
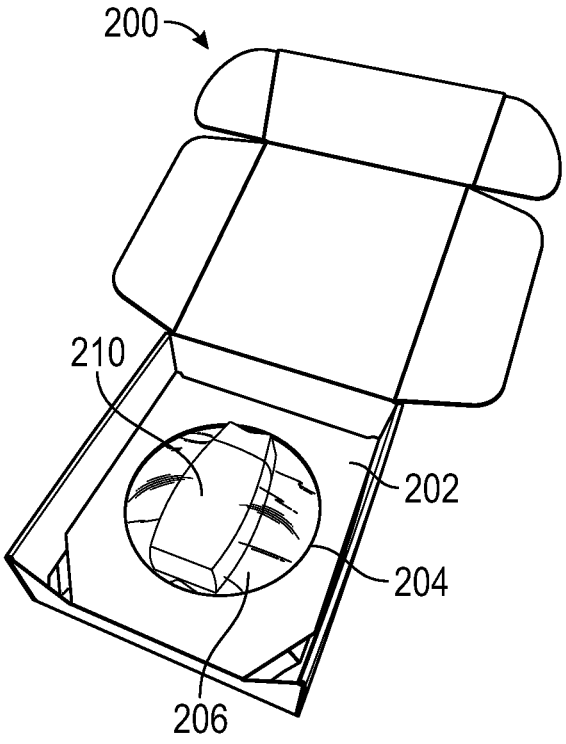

FIGS. 9 and 10 show a box 200 comprising a product support assembly 202 including an opening 204 having a second size and a polymeric sleeve 206. The second size of the opening 204 can be larger than the first size of the opening 104 of box 100 in FIGS. 7 and 8. In FIG. 9, the box 200 contains a first product 208 and in FIG. 10, the box 200 contains a second product 210, the second product 210 having a different shape and size than the first product 208.

In this way, modular sized boxes (such as boxes 100 and 200) can fit a range of products within a same line of boxes.

Figure 11:
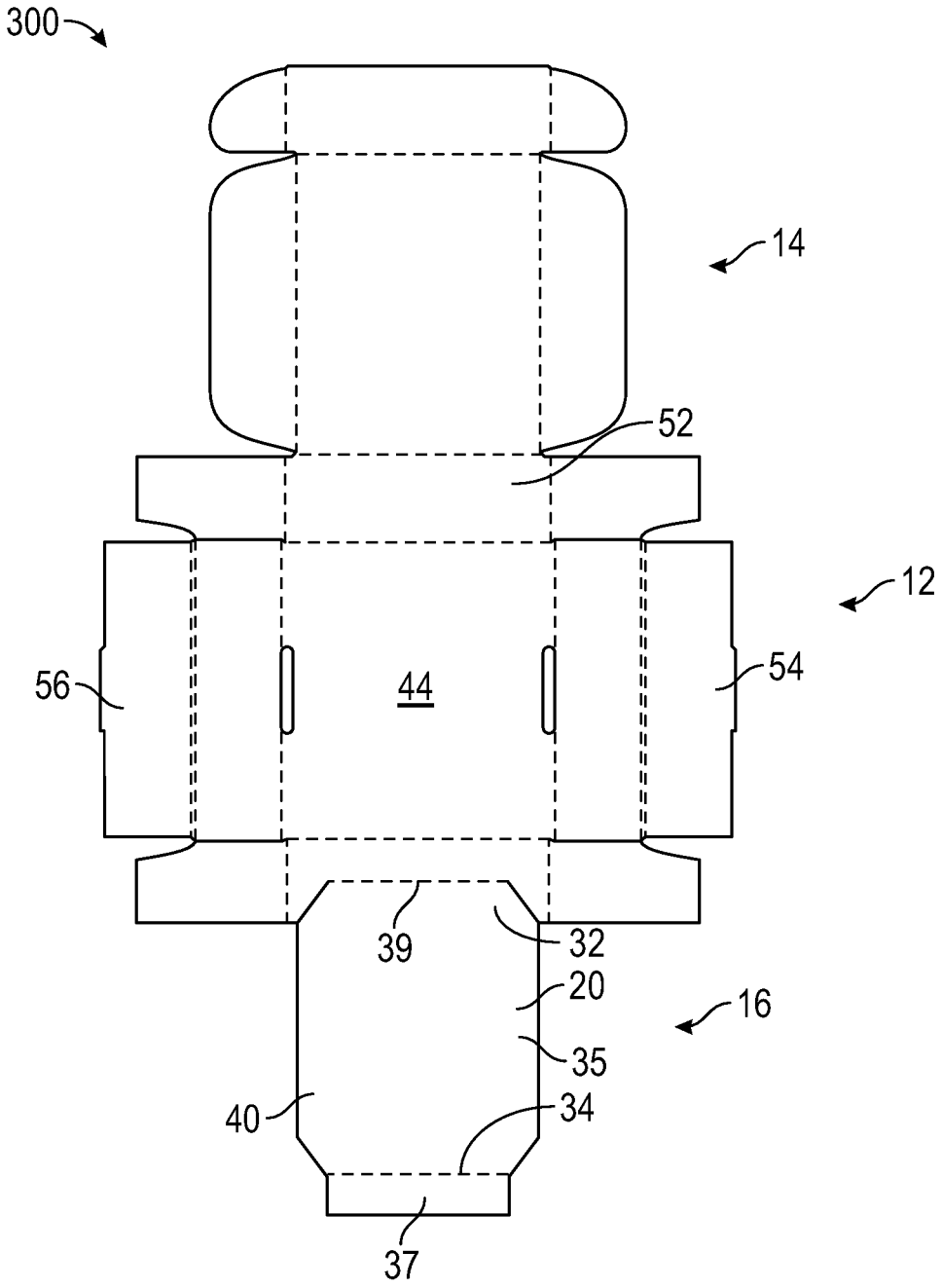
FIG. 11 is a top plan view of another representative embodiment of a blank from which another embodiment of a box with a pivotable product support assembly and separable sleeve can be constructed.

In certain embodiments, the product support assembly can include fewer than two panels (e.g., a single panel) or more than two panels (e.g., three panels, four panels, etc.). For example, FIG. 11 illustrates another representative example of a blank 300 from which a container or box with a product-retaining sleeve or film can be assembled wherein the product support assembly 16 includes one panel. The box that can be assembled from the blank 300 can be configured similarly to the box 10 shown in FIGS. 1-5 and the blank 300 can be configured similarly to the blank 80 of FIG. 6. As such, similar components between blank 80 and blank 300 are labeled similarly in FIG. 11.

As shown in the embodiment of FIG. 11, the blank 300 does not include a viewing panel (e.g., viewing panel 18, as shown in FIG. 6), and instead, the product platform 20 is directly coupled to the container portion 12. In such an embodiment, the product platform 20 can be pivotably coupled directly to the container portion 12. The product platform 20 can be configured to receive a product-retaining sleeve (e.g., sleeve 36 shown in FIGS. 1-4) around the product platform 20, as described above with reference to FIGS. 1-4, which can be configured to retain a product against either or both surfaces of the product platform 20.

Different embodiments of the boxes described herein can provide one or more significant advantages over existing boxes. For example, certain embodiments of the containers (e.g., boxes) described herein can securely support the product inside the container during shipping, allow the user to view the product upon opening the container, and can provide improved recyclability. Because the sleeve 36 is not attached, adhered, or secured to the product platform 20, the sleeve can be slipped over or cut off of the product platform by the user. With the polymeric sleeve easily and fully separable from the cellulosic or paperboard material of the box, and with the absence of adhesives and fasteners securing the sleeve and the box to one another, the box and sleeve materials can be separated from one another and recycled. The embodiments described herein can also be configured to receive products having a non-standard shape and/or size which would otherwise require vacuum-forming.

Explanation of Terms

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved.

Although the operations of some of the disclosed embodiments are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

As used herein, the terms "box" and "container" refer to an article that is capable of holding one or more products or other physical articles. As used herein, the term "cardboard box" refers to a box formed from any of a variety of heavy paper-like materials (e.g., cellulosic fiber-based materials), including, for example, cardstock, corrugated fiberboard, and/or paperboard. As used herein, the term "corrugated paperboard" refers to a fluted corrugated medium with one or more flat liner layers coupled thereto, such as a central corrugated layer with a first liner layer on one side and a second liner layer on another side of the central corrugated layer.

As used herein, the term "blank" refers to a flat sheet of material that is formed into a container, such as a flat sheet of corrugated paperboard. As used herein, the term "flat-formed" refers to an article that is manufactured from one or more flat pieces, such as a blank, that is manipulated into a different shape, such as by folding. As used herein, the terms "hingedly coupled" and/or "pivotably coupled" refers to any manner of engagement between a first part of a blank relative to a second part of the blank which allows the first part to travel relative to the second part without the first part becoming disengaged from the second part, such as by one or more fold lines, one or more cut lines, and/or some combination thereof. As used herein, the term "cut line" refers to an area that includes a cut that extends at least partially through the blank to facilitate folding, tearing, and/or some other structural advantage. Cut lines can be straight, curved, or some other shape, and can include perforation lines in which the cut is not continuous along the length of the cut line (i.e., a perforated line is a cut line that is discontinuous).

Unless otherwise indicated, all numbers expressing angles, dimensions, quantities of components, forces, moments, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited. Furthermore, not all alternatives recited herein are equivalents and/or perform equally well, nor are alternatives listed in a preferred order unless stated otherwise.

In view of the many possible embodiments to which the principles of the disclosed technology may be applied, it should be recognized that the illustrated embodiments are only examples and should not be taken as limiting the scope of the disclosure. Rather, the scope of the disclosure is at least as broad as the following claims. We therefore claim all that comes within the scope and spirit of these claims.

The invention claimed is:

1. A container, comprising:

a container portion comprising a plurality of walls;

a first panel pivotably coupled to the container portion and configured to pivot between a first position where the first panel is arranged outside of the container portion and a second position where the first panel is arranged inside the container portion; and a tubular polymeric sleeve disposed around the first panel and covering a first surface of the first panel and a second surface on the opposite side of the first panel from the first surface, wherein the polymeric sleeve is unsecured to the first panel, wherein the first panel is pivotably coupled to the container portion via a second panel of the container portion, the second panel including a first end portion pivotably coupled to a wall of the plurality of walls of the container portion and a second end portion, the first panel pivotably coupled to the second end portion of the second panel; and wherein in the second position the first surface of the first panel is arranged against the second panel and both the first panel and the second panel are arranged inside the container portion.

2. The container of claim 1, wherein the first panel includes a support panel extending outward from a main panel portion of the first panel and coupled to the main panel portion at a fold line.

3. The container of claim 2, wherein the first panel is pivotably coupled to the second panel at a first end portion of the first panel and wherein the support panel is arranged at a second end portion of the first panel, the first end portion of the first panel arranged opposite the second end portion of the first panel, across the first panel.

4. The container of claim 3, wherein in the second position of the first panel, a free end of the support panel is configured to contact a bottom wall of the container portion and the main panel portion of the first panel is suspended above the bottom wall.

5. The container of claim 1, wherein the second panel is pivotably coupled to a front wall of the container portion and further comprising a cover pivotably coupled to a rear wall of the container portion.

6. The container of claim 1, wherein in the first position the first surface of the first panel is arranged against the second panel and both the first panel and the second panel are arranged outside of the container portion and wherein the first panel is further pivotable between a third position and the first position, the first panel extending away from the second panel in the third position.

7. The container of claim 6, wherein in the first position and the second position, one layer of the tubular polymeric sleeve is sandwiched between the first panel and the second panel.

8. The container of claim 1, wherein the second panel includes an opening and wherein in the second position the tubular polymeric sleeve is viewable through the opening.

9. The container of claim 1, wherein the tubular polymeric sleeve comprises a resiliently stretchable polymeric film.

10. A container, comprising:

a container portion comprising a plurality of walls;

a first panel pivotably coupled to the container portion and configured to pivot between a first position in which the first panel is disposed outside the container portion and a second position in which the first panel is received within the container portion;

a second panel pivotably coupled to the first panel, the second panel being pivotable between a first position in which the second panel extends away from the first panel and a second position in which the second panel is received against the first panel; and a polymeric sleeve disposed around the second panel, the polymeric sleeve unsecured to the second panel, wherein when the second panel is in the second position a side of the polymeric sleeve that is configured to retain a product inserted inside the polymeric sleeve against the second panel is arranged between the first panel and the second panel.

11. The container of claim 10, wherein the second panel extends from the first panel and is pivotably coupled to a first end portion of the first panel and wherein a second end portion of the first panel is pivotably coupled to a front wall of the container portion, the first end portion and the second end portion arranged opposite one another across the first panel.

12. The container of claim 10, wherein the first panel defines an opening therein and wherein the opening is arranged against the second panel and the polymeric sleeve when the second panel is in the second position.

13. The container of claim 10, further comprising two or more support panels, including one or more first support panels extending from and pivotably coupled to the first panel and a second support panel extending from and pivotably coupled to the second panel, wherein the two or more support panels are configured to support the first panel and the second panel against a bottom wall of the container portion when the first panel is in the second position and the second panel is in the second position.

14. The container of claim 10, wherein the polymeric sleeve is tubular with at least one open end.

15. A container, comprising:

a container portion comprising a plurality of walls;

a cover coupled to the container portion and configured to pivot between a closed position and an open position;

a first panel pivotably coupled to the container portion and configured to pivot between a first position in which the first panel is disposed outside the container portion and a second position in which the first panel is received within the container portion, the first panel defining an opening;

a second panel pivotably coupled to the first panel and extending from the first panel, the second panel being pivotable between a first position in which the second panel extends away from the first panel and a second position in which a first surface of the second panel is received on the first panel, and wherein in the second position of the first panel, the first surface of the second panel is arranged against the second panel and both the first panel and the second panel are arranged inside the container portion; and a polymeric sleeve disposed around the second panel and rotatable around the second panel, the polymeric sleeve covering the first surface and a second surface of the second panel that is disposed opposite the first surface, the polymeric sleeve being configured to retain a product inserted inside the polymeric sleeve against the second panel.

16. The container of claim 15, wherein the polymeric sleeve includes at least one open end and wherein the polymeric sleeve is translatable along the second panel.

17. The container of claim 15, wherein the polymeric sleeve is not adhered or fastened to the second panel.

18. The container of claim 15, wherein the polymeric sleeve is stretchable and wherein the polymeric sleeve is transparent or translucent.

* * * * *